US009383103B2

(12) United States Patent
Pianezze et al.

(10) Patent No.: US 9,383,103 B2
(45) Date of Patent: Jul. 5, 2016

(54) GAS LIGHTING DEVICE FOR AN ELECTRIC HOUSEHOLD APPLIANCE, IN PARTICULAR A COOKING RANGE, HAVING A QUICK CONNECTION SYSTEM TO THE ELECTRODES

(71) Applicant: ITW INDUSTRIAL COMPONENTS S.R.L. CON UNICO SOCIO, Milan (IT)

(72) Inventors: Daniele Pianezze, Cassano Magnago (IT); Massimo Aleardi, Cassano Magnago (IT)

(73) Assignee: ITW INDUSTRIAL COMPONENTS S.R.L. CON UNICO SOCIO, Milan (IT)

( * ) Notice: Subject to any disclaimer, the term of this patent is extended or adjusted under 35 U.S.C. 154(b) by 0 days.

(21) Appl. No.: 14/218,881

(22) Filed: Mar. 18, 2014

(65) Prior Publication Data

US 2014/0199645 A1 Jul. 17, 2014

Related U.S. Application Data

(63) Continuation of application No. 12/529,322, filed as application No. PCT/IB2008/000683 on Mar. 24, 2008, now abandoned.

(30) Foreign Application Priority Data

Mar. 26, 2007 (IT) ..... TO2007A0216

(51) Int. Cl.
*F23Q 7/06* (2006.01)
*F23Q 3/00* (2006.01)

(52) U.S. Cl.
CPC . *F23Q 3/006* (2013.01); *F23Q 3/00* (2013.01)

(58) Field of Classification Search
CPC ..... F23Q 3/006; F23Q 3/00; B60L 1/006; H01R 13/405; H01R 13/743; H01R 13/6273; H01R 43/24; H01R 4/26; H01R 9/00; H01R 11/00; H01R 13/6585
USPC ..... 431/258, 7, 254, 255, 263, 264; 126/39 BA, 39 E; 361/253, 263, 600, 361/679, 728, 730, 736, 752; 315/362, 363, 315/7, 32, 169.3; 219/522, 260–270; 362/7
See application file for complete search history.

(56) References Cited

U.S. PATENT DOCUMENTS 3,950,124 A 4/1976 Berry
4,386,385 A 5/1983 Hamilton et al.

(Continued)

FOREIGN PATENT DOCUMENTS

EP 1101067 A1 5/2001
FR 2212516 A1 7/1974

(Continued)

OTHER PUBLICATIONS

Nobel Prize, Plastics, First Published Aug. 28, 2007.*

(Continued)

*Primary Examiner* — Kenneth Rinehart
*Assistant Examiner* — Bao D Nguyen
(74) *Attorney, Agent, or Firm* — Hauptman Ham, LLP

(57) ABSTRACT

An electronic gas lighting device including: a cup-shaped casing, formed by an electrically insulating material; a plurality of high-voltage outputs carried by the casing and each including a chimney-like housing carried by the casing and also formed by an electrically insulating material and a first electric contact carried by the chimney-like housing and arranged therein; and a frame element integrally and protrudingly carrying, on a first face thereof intended in use to face towards the casing, a plurality of second contacts, in number equal to the high-voltage outputs present on the casing and adapted to couple with the first contacts within said chimney-like housings, and provided on a second face thereof, opposite to the first, with a plurality of electric wires each connecting a second contact with a spark generating electrode fastenable to a cooking range; snapping fastening means to the casing being peripherally arranged on the outside of the frame element, along at least one side of the same.

23 Claims, 2 Drawing Sheets

(56) References Cited

U.S. PATENT DOCUMENTS

| | | | | |
|---|---|---|---|---|
| 5,425,631 | A | 6/1995 | Krueger et al. | |
| 5,988,652 | A | 11/1999 | Martin et al. | |
| 6,102,726 | A | 8/2000 | Tsuji et al. | |
| 6,429,606 | B1 | 8/2002 | Aleardi et al. | |
| 6,478,609 | B1 | 11/2002 | Davis et al. | |
| 6,506,047 | B1 | 1/2003 | Aleardi et al. | |
| 6,796,792 | B1 | 9/2004 | Aleardi et al. | |
| 7,097,447 | B2 | 8/2006 | Pianezze | |
| 7,497,728 | B2 | 3/2009 | Moskwa et al. | |
| 2005/0052819 | A1* | 3/2005 | Pianezze | 361/263 |
| 2006/0172612 | A1 | 8/2006 | Wasalaski et al. | |
| 2008/0090191 | A1 | 4/2008 | Graham | |
| 2008/0108243 | A1* | 5/2008 | Corona | 439/352 |
| 2009/0098495 | A1 | 4/2009 | Pianezze | |
| 2010/0043773 | A1 | 2/2010 | Aleardi et al. | |

FOREIGN PATENT DOCUMENTS

| | | | |
|---|---|---|---|
| WO | 0007217 | A2 | 2/2000 |
| WO | 2006093475 | A1 | 9/2006 |

OTHER PUBLICATIONS

ISR for PCT/IB2008/000683 dated Oct. 2, 2008.

* cited by examiner

GAS LIGHTING DEVICE FOR AN ELECTRIC HOUSEHOLD APPLIANCE, IN PARTICULAR A COOKING RANGE, HAVING A QUICK CONNECTION SYSTEM TO THE ELECTRODES

RELATED APPLICATIONS

The present application is a continuation of U.S. application Ser. No. 12/529,322 filed Aug. 31, 2009, which is a National Phase of PCT/IB2008/000683 filed Mar. 24, 2008, which claims priority to Italian Application Number TO2007A000216 filed Mar. 26, 2007, the disclosures of which are hereby incorporated by reference herein in their entirety.

TECHNICAL FIELD

The present invention relates to an electronic gas lighting device, of the type intended to equip an electric household appliance, such as for example a cooking range, for determining the controlled lighting of the burners by supplying a high voltage to electrodes fixable to the cooking range, provided with a quick connection device of the electrodes to the high-voltage outputs of the gas lighting device.

BACKGROUND ART

It is known from EP1101067B1, to the same Applicant, an electronic gas lighting device including a casing formed by electrically insulating material provided with a plurality of high-voltage outputs each defined by a chimney-like housing, integrally obtained with the casing and carrying a corresponding high-voltage contact therein, e.g. a male faston connector. In use, each contact in the chimney-like housings must be connected, by means of an electric wire, to a corresponding spark generating electrode, fixable to the cooking range at a burner. For this purpose, on one end, the electric wire is pre-wired, e.g. crimped or welded, to the electrode and, on the other end, is pre-wired in an identical manner to a female faston connector, which must then be inserted in use onto the male faston connector inside the chimney-like housing, so as to protect the electric connection with an electrically insulating element (indeed the chimney-like housing of the casing).

The above-described known device is more than satisfactory. However, the assembly times of the electric wires on the high-voltage outputs of the gas lighting devices are relatively long; furthermore, due to possible incorrect manoeuvres by the assembly operator, the male and female faston connectors may not be correctly coupled, causing even possible deformations of the same. For the same reason, the electric household appliance manufacturer cannot automatically assemble the wires onto the high-voltage outputs of the gas lighting device, because it would be essentially impossible to ensure the correct, simultaneous positioning of all male contacts with all female contacts.

DISCLOSURE OF INVENTION

It is thus the object of the present invention to improve the known gas lighting devices in the part relating to the electric connection of the electrodes to the gas lighting device, by providing a gas lighting device for an electric household appliance, in particular a cooking range, which is easily and rapidly connectable to the electrodes by means of electric supply wires, so as to avoid errors by the assembly operator, and to allow the electric household appliance manufacturer, if desired, to perform the assembly in an entirely automatic manner; this all guaranteeing low production and assembly costs, small sizes and high operating reliability.

The present invention thus relates to an electronic gas lighting device as defined in claim 1.

The invention also relates to a high-voltage output quick connection device in an electronic gas lighting device with corresponding spark generating electrodes fastenable onto an electric household appliance, as defined in claim 9.

In particular, the electronic gas lighting device according to the invention comprises a cup-shaped casing, formed by an electrically insulating material; a plurality of high-voltage outputs carried by the casing and each comprising a chimney-like housing carried by the casing and also formed by an electrically insulating material and a first electric contact carried by the chimney-like housing and arranged therein; and a frame element integrally and protrudingly carrying, on a first face thereof intended in use to face the casing, a plurality of second contacts, in number equal to the high-voltage outputs present on the casing and adapted to couple with the first contacts within said chimney-like housings; the frame element being further provided on a second face thereof, opposite to the first, with a plurality of electric wires each connecting a second contact with a spark generating electrode fastenable to the household appliance; and with snapping fastening means to the casing peripherally arranged on the outside of the frame element, along at least one side of the same.

Each chimney-like housing is provided with an open end for the reception of a corresponding second contact and carries therein a corresponding first contact mounted close to a bottom wall of the chimney-like housing, opposite to the open end, so as to remain away from the open end and well within the chimney-like housing.

Similarly, the frame element is integrally provided, on the first face thereof and for each second contact, with a longeron-shaped guide element adapted to slidingly couple, for the entire length thereof, within a corresponding chimney-like housing, through the open end of the same, to guide the second contact into electric coupling with the corresponding first contact arranged within the chimney-like housing.

In this manner, the frame element with the second contacts and the electric wires, already pre-wired to the second contacts and to the electrodes, forms a quick connection device of the electrodes to the high-voltage outputs providing as a whole a compact and cost-effective electronic gas lighting device mountable with extreme quickness and simplicity and in which it is not possible for the assembly operator to produce damages at the contacts, because the electric connection of the first contacts with the second ones is totally guided by the longeron-shaped guide elements which slidingly couple with the internal side wall of the chimney-like housings, besides ensuring a much firmer and more secure reciprocal mechanical connection of the first and the second contacts. Finally, this being a pre-wireable device for subassemblies later reciprocally coupled with a single simple movement (the casing with the chimney-like housings and containing the electronics on one side and the frame element with the electric wires and the second contacts on the other) it allows the manufacturer to provide an entirely automatic assembly cycle.

Finally, being the mechanical coupling part between the contacts entirely formed by non-conductive elements, such as the guide elements and the corresponding chimney-like housings, the contacts can be made in a non-traditional manner, e.g. as simple flat terminals, which are in use simply facing each other and arranged at a sufficiently small predetermined distance (thus not necessarily in reciprocal contact) into an insulated environment formed by the chimney-like housings. The aforesaid contacts, indeed, being high-voltage contacts, may transmit electric current in the form of discharge with perforation of the dielectric constituted by the air between the facing contacts.

BRIEF DESCRIPTION OF THE DRAWINGS

Further features and advantages of the invention will be apparent from the following description of a non-limitative embodiment thereof, with reference to the figures in the accompanying drawings, wherein.

BEST MODE FOR CARRYING OUT THE INVENTION

Figure 1:
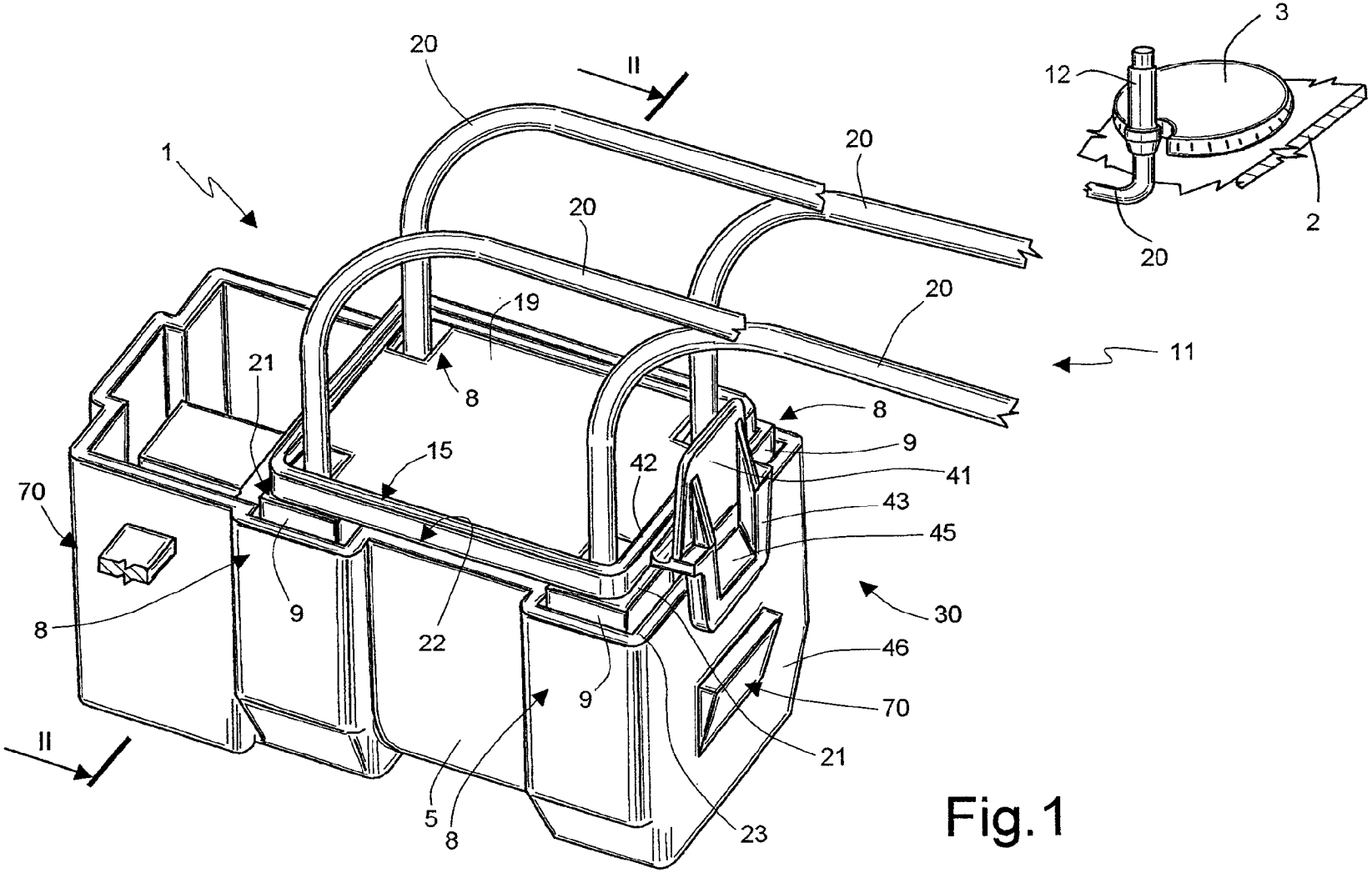
FIG. 1 shows a front three-quarter perspective view of an electronic gas lighter device made according to the invention, and shown in a use configuration.
Figure 2:
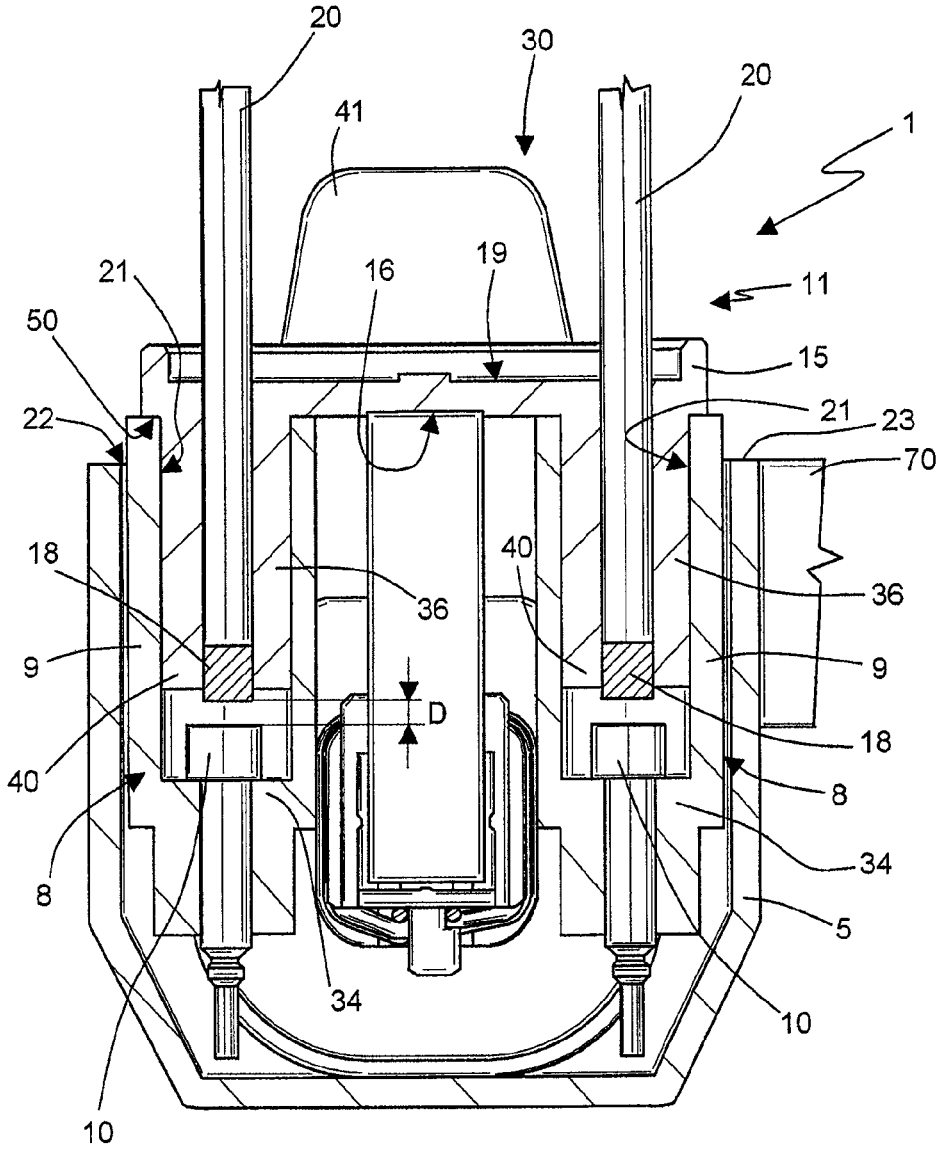
FIG. 2 shows on enlarged scale a section elevation view taken along a plotting plane II-II of the gas lighting device in FIG. 1.

With reference to FIGS. 1 and 2, numeral 1 indicates as a whole a gas lighting device for an electric household appliance, a cooking range 2 in this non-limiting illustrated embodiment, provided with a plurality of burners 3 (only one of which is shown for the sake of simplicity); the device 1 comprises a cup-shaped casing 5, formed by an electrically insulating material, e.g. by moulding of a synthetic plastic material, and a plurality of high-voltage outputs 8 carried by the casing 5 and each comprising (FIG. 2) a chimney-like housing 9 carried by the casing 5 and also formed by an electrically insulating material and an electric contact 10 carried by the chimney-like housing 9 and arranged therein.

The gas lighting device 1 further comprises a quick connection device 11 of the high-voltage outputs 8 of the casing 5 to corresponding spark generating electrodes 12, also belonging to the gas lighting device 1 as a whole and fixable in use in a known manner, each close to a corresponding burner 3 on the cooking range 2 in order to be able to control the lighting in a known manner.

The device 11 comprises a frame element 15 integrally and protrudingly carrying, on a first face 16 thereof (FIG. 2) intended in use to face the casing 5, a plurality of second contacts 18, in number equal to the high-voltage outputs 8 present on the casing 5 and adapted to couple with contacts 10 inside the chimney-like housings 9. The frame element 15 is further provided, on a second face 19 thereof, opposite to the face 16, with a plurality of electric wires 20 each connecting a contact 18 with a spark generating electrode 12.

In the non-limiting embodiment shown, the chimney-like housings 9 are made as a non-integral part of the casing 5, but instead are independent elements, arranged at least in part within the casing 5 (in which they are embedded and blocked in use by means of resining) and so as to overhangingly protrude, with corresponding open ends 21 thereof, through a mouth 22 of the cup-shaped casing 5, but only immediately over a peripheral edge 23 of the mouth 22; in such a case, the frame element 15 is defined by a plate-shaped lid adapted to couple by resting on the open ends 21 protruding from the mouth 22 to close the same and essentially cover the mouth 22, so as to protect the resining underneath which fills the casing 5 in use.

It is however apparent that the foregoing and the following description is perfectly applicable also to a casing 5 of a more traditional type, in which the chimney-like housings 9 are integrally obtained in one piece with the casing 5 and protrude from the same from a side opposite to the mouth 22.

However, the quick connection device 11 is completed by snapping fastening means 30 of the frame element 15 to the casing 5 peripherally arranged on the outside of the frame element 15, along at least one side of the same.

In particular, the open end 21 of each chimney-like housing 9 allows the reception in the same of a corresponding contact 18 for coupling with the contact 10, because the latter is mounted close to (onto, in this case) a bottom wall 34 (FIG. 2) of the chimney-like housing 9, opposite to the open end 21, so as to remain away from the open end 21 and well within the chimney-like housing 9.

According to an important aspect of the invention, the frame element 15 is integrally provided on the face 16 and perpendicularly protrudingly with respect to the same, for each existing contact 18, with a longeron-shaped guide element 36 (FIG. 2) adapted to slidingly couple, for the entire length thereof, within a corresponding chimney-like housing 9, through the open end 21 of the same, to guide the contact 18 it carries into electric coupling with the corresponding contact 10 arranged within the chimney-like housing 9.

In particular, the frame element 15 and the guide elements 36 are formed in a one-piece single part by moulding an electrically non-conducting material, in this case a synthetic plastic material; the contacts 18 are also carried by, and embedded at least in part in, the guide elements 36, so as to be protrudingly carried with respect to the face 16, each at a free end 40 (FIG. 2) of a corresponding guide element 36.

The contacts 18 are further fastened and connected in a pre-wired manner with the spark generating electrodes 12 by means of the electric wires 20, the opposite ends of which are electrically and mechanically connected, in a pre-wired manner, to the contacts 18 on one side and to the electrodes 12 on the other, e.g. by crimping or soldering. In this case, the ends of the wires 20 are, on the end of the contacts 18 (i.e. on the opposite side of the electrodes 12), also at least in part embedded in the longeron-shaped guide elements 36 along with the contacts 18.

The guiding elements 36 are shaped so as to display a peripheral profile mating with the inner peripheral profile of the chimney-like housings 9, so that the outer side surfaces thereof cooperate in use with the inner side surfaces of the chimney-like elements 9; in this manner, a firm mechanical coupling is obtained between casing 5 and frame element 15 already with the simple insertion of the longeron-shaped elements 36 in the housings 9 arranged for them, coupling later completed by the fastening means 30.

However, in virtue of the described conformation of the guide elements 36 and the chimney-like housings 9, the snapping fastening means 30 to the casing 5 may be simplified and consisting of a single elastic fin 41 (instead of, for example, of a plurality of fins) arranged on one single side 42 of the frame element 15, between a pair of guide elements 36, overhangingly protruding from the frame element 15 with respect to both faces 16 and 19, perpendicularly to the same and provided towards the casing 5 with a fastening end 43, in this case slot-shaped, adapted to snappingly couple with a corresponding peg 45, in this case tooth-shaped, integrally obtained with the casing 5 on a side wall 46 of the same.

According to a further preferred aspect of the invention, the contacts 10 are defined by corresponding flat terminals carried just at the bottom walls 34 of the chimney-like housings 9, parallelly to the same and, similarly, the contacts 18 are also defined by corresponding flat terminals (diagrammatically indicated by a dashed line) of size either equal to or lower than that of the flat terminals defining the contacts 10, directly carried at the free ends 40 of the longeron-shaped guide elements 36, intended in use to face the bottom walls 34 of the chimney-like housings 9, as shown in FIG. 2.

In particular, with reference to such a figure, the frame element 15 is provided with abutting means 50 cooperating with the casing 5 (in this case, with the peripheral edge 23 delimiting the mouth 22) for positioning the contacts 18 with the corresponding ends 40 at a distance D predetermined by the contacts 10 with the corresponding bottom walls 34, and facing the latter.

The described gas lighting device 1 is completed by known snapping fastening means 70 to the cooking range 2, shown only in part for simplicity.

In such a manner, it is not necessary in use to mechanically couple the contacts 10 with the contacts 18, and therefore it is no longer even necessary to make the same as male and female, respectively. The mechanical coupling is indeed already ensured by the frame element 15 with the longeron-shaped guide elements 36 thereof, which couple with the chimney-shaped housings 9, coupling which can be made with greater accuracy than a coupling between traditional contacts of the faston-type and which does not require a great positioning accuracy because it is essentially self-positioning. On the other hand, the positioning of the contacts 10 simply close to the contacts 18, without even needing a direct physical contact, being high-voltage operating contacts, however allows the necessary passage of electric current for supplying the sparking on the electrodes 12, also because the current passage occurs in a closed and insulated environment, delimited between the bottom walls 34, the ends 40 and the side walls of the housings 9.

The invention claimed is:

1. An electronic gas lighting device for an electric household appliance, said device comprising:

a cup-shaped casing formed by an electrically insulating material;

a plurality of housings arranged in said cup-shaped casing and formed by electrically insulating material, said plurality of housings carrying a plurality of voltage outputs, and a plurality of first electric contacts;

a frame element having a first face configured to face toward the cup-shaped casing and a second face configured to face away from the cup-shaped casing; and a snapping fastening element provided along at least one side of the frame element for fastening the frame element to the cup-shaped casing, wherein said frame element integrally and protrudingly carries, on the first face thereof, a plurality of second contacts corresponding to the voltage outputs and adapted to couple with the first electric contacts, the frame element carries, on the second face thereof, a plurality of electric wires each having one end connected to one of the second contacts and another end adapted to be connected to a spark generating electrode fastenable to the household appliance, said frame element is integrally formed with guide elements in direct contact with the second contacts for guiding the second contacts to electrically couple with the first electric contacts, said frame element is further integrally moulded with a lid configured to cover the cup-shaped casing and defining an abutting element, and wherein the abutting element is configured to cooperate with the cup-shaped casing for positioning the second contacts such that there is a gap between respective second contacts and respective first electric contacts.

2. The device according to claim 1, wherein said housings comprise open ends protruding outward from a mouth of the cup-shaped casing and immediately over a peripheral edge of said mouth, and the lid of said frame element is a plate-shaped lid adapted to rest on said open ends to cover said mouth.

3. The device according to claim 1, wherein each of said housings comprises an open end for receiving one of the second contacts; and a bottom wall opposite to the open end and carrying one of the first electric contacts corresponding to said second contact, and said first electric contact remains within the housing.

4. The device according to claim 3, wherein said guide elements are integrally provided, on said first face to slidingly couple, over an entire length of the guide elements, the frame element with the cup-shaped casing, and each of the guide elements extends through the open end of the corresponding housing, to guide the corresponding second contact into electric coupling, without being in direct physical contact with the housing, with the corresponding first electric contact arranged within the housing.

5. The device according to claim 4, wherein said frame element and said guide elements for the second contacts are formed in a single moulded electrically insulating piece, and said second contacts are directly embedded at least in part within said guide elements.

6. The device according to claim 4, wherein said snapping fastening element comprises a single elastic fin arranged on said at least one side of the frame element between a pair of said guide elements for the second contacts, and perpendicularly and overhangingly protruding from the frame element with respect to both said first and second faces of the frame element, a fastening end extending toward the cup-shaped casing; and a corresponding peg integrally formed with the fastening end, said fastening end being adapted to snappingly couple with the corresponding peg.

7. The device according to claim 4, wherein said first electric contacts comprise first flat terminals at the bottom walls of the housings and parallel to the bottom walls, said second contacts comprise second flat terminals having a size either equal to or smaller than that of the first flat terminals, directly carried at respective free ends of the guide elements of the frame element, and adapted to face toward said bottom walls of the housings when the frame element is fastened by the guide element to the cup-shaped casing.

8. The device according to claim 4, wherein the guide elements have free ends opposite to the bottom walls of the housings, and the second contacts protrude beyond the free ends and are adapted to be spaced away from the corresponding first electric contacts carried on the bottom walls of the housings when the frame element is coupled with the cup-shaped casing.

9. The device according to claim 4, wherein the guide elements carrying the second contacts are insertable into the housings in a predetermined direction perpendicular to the first and second faces of the frame element to face toward the first electric contacts carried on the bottom walls of the housings.

10. The device according to claim 1, wherein the guide elements on the first face are in direct contact with the second contacts over an entire length of the guide elements for guiding the second contacts to electrically couple with the first electric contacts.

11. A voltage output quick connection device for an electronic gas lighting device with corresponding spark generating electrodes fastenable onto an electric household appliance, said voltage output quick connection device comprises:

a frame element having first and second opposite faces, the first face adapted to face toward a casing of the gas lighting device and the second face adapted to face away from the casing;

wherein said frame element integrally and protrudingly carries, on the first face thereof, a plurality of contacts, corresponding to voltage outputs in the casing, and on the second face thereof, a plurality of electric wires each having one end connected, in a pre-wired manner, to one of said contacts and another end adapted to be connected with one of said spark generating electrodes, said frame element is integrally formed with guide elements in direct contact with the plurality of contacts, said frame element includes a lid configured to cover the casing and defining an abutting element, the frame element and the lid being part of a monolithic structure, and the voltage output quick connection device further comprises a plurality of second contacts, wherein the abutting element is configured to cooperate with the casing for positioning the second contacts at a predetermined distance from the first contacts such that there is a gap between respective first contacts and respective second contacts.

12. The device according to claim 11, wherein said guide elements are integrally provided, on said first face to slidingly couple, over an entire length of the corresponding guide elements, the frame element with the casing of the gas lighting device, each of said contacts is partially embedded within a free end of the corresponding guide element, and said one end of said electric wire is fastened to the contact.

13. The device according to claim 11, wherein said guide elements are longeron-shaped, and said frame element and said longeron-shaped guide elements are formed in a single moulded electrically non-conducting piece.

14. The device according to claim 13, wherein the electrically non-conducting piece is a synthetic plastic material.

15. An assembly, comprising:

an apparatus, including:

a voltage output quick connection device for an electronic gas lighting device with corresponding spark generating electrodes fastenable onto an electric household appliance, the voltage output quick connection device including:

a frame element, wherein said frame element includes a plurality of elongate guide elements spaced apart from one another and a linking member that links the plurality of elongate guide elements to one another, wherein the plurality of elongate guide elements extend away from the linking member and are adapted to extend into a casing of the gas lighting device, respective elongate guide elements respectively carry first contacts corresponding to voltage outputs in the casing, a plurality of electric wires each having one end connected, in a pre-wired manner, to respective first contacts and another end adapted to be connected with one of said spark generating electrodes, and the frame element is formed such that the elongate guide elements are in direct contact with respective first contacts, wherein the respective first contacts are respectively protrudingly carried by the respective elongate guide elements such that respective ends of contacts facing away from the respective wires are located beyond a longitudinal extent of the respective elongate guide element; and the casing, wherein the casing is formed by an electrically insulating material and includes a plurality of second contacts located in the casing, wherein the frame element includes abutting surfaces configured to cooperate with the casing for positioning the first contacts at a predetermined distance from respective second contacts located in the casing such that there is a gap between respective first contacts and respective second contacts.

16. The assembly according to claim 15, wherein said elongate guide elements are longeron-shaped, and said frame element and said longeron-shaped guide elements are formed in a single moulded electrically non-conducting piece.

17. The assembly according to claim 15, wherein the electrically non-conducting piece is a synthetic plastic material.

18. The assembly according to claim 15, wherein the frame element is configured such that the respective ends of contacts facing away from the respective wires are proud of all portions of the voltage output quick connection device.

19. The assembly according to claim 15, wherein the frame element is configured such that the respective ends of contacts facing away from the respective wires extend beyond any portion of the voltage output quick connection device relative to the direction of extension of the elongate guide elements away from the linking member.

20. The assembly according to claim 15, wherein the frame element is integrally molded.

21. The assembly according to claim 15, wherein the frame element is a monolithic component.

22. The assembly according to claim 15, wherein the elongate guide elements are configured such that there is open space between at least two of the elongate guide elements that is at least as wide as the maximum diameter of one of the elongate guide elements all when measured on a plane normal to a direction of extension of the one of the elongate guide elements.

23. The assembly according to claim 15, wherein:

the elongate guide elements and the linking member are part of a monolithic component.

* * * * *